US006389245B2

(12) United States Patent
Shida et al.

(10) Patent No.: US 6,389,245 B2
(45) **Date of Patent: *May 14, 2002**

(54) DEVELOPING DEVICE AND IMAGE FORMING APPARATUS

(75) Inventors: Masanori Shida, Shizuoka-ken; Yoshiaki Kobayashi, Numazu; Masaru Hibino, Minami Ashigara; Ichiro Ozawa, Funabashi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/359,733

(22) Filed: Jul. 23, 1999

(30) Foreign Application Priority Data

Jul. 29, 1998 (JP) ..... 10-228633

(51) Int. Cl.[7] ..... G03G 15/08
(52) U.S. Cl. ..... 399/58; 399/274
(58) Field of Search ..... 399/58, 61, 62, 399/63; 3/272, 274, 284, 44; 430/106.6, 109

(56) References Cited

U.S. PATENT DOCUMENTS 4,112,867 A * 9/1978 Suzuki et al. ..... 399/63
4,868,601 A * 9/1989 Morimoto et al. ..... 118/689
4,924,270 A * 5/1990 Sako et al. ..... 399/63
4,941,019 A 7/1990 Honda et al. ..... 355/251
5,001,517 A * 3/1991 Hosaka et al. ..... 399/274
5,365,319 A * 11/1994 Sakemi et al. ..... 399/44
5,525,752 A * 6/1996 Izumizaki et al. ..... 399/272
5,621,505 A 4/1997 Kobayashi et al. ..... 399/274
5,766,814 A * 6/1998 Baba et al. ..... 430/106.6
5,893,010 A * 4/1999 Nagashima et al. ..... 399/62
6,067,433 A 5/2000 Kimura et al. ..... 399/274

FOREIGN PATENT DOCUMENTS

| | | |
|---|---|---|
| JP | 55-32060 | 3/1980 |
| JP | 59-165082 | 9/1984 |
| JP | 05-61353 | 3/1993 |

* cited by examiner

*Primary Examiner*—Quana M. Grainger
(74) *Attorney, Agent, or Firm*—Fitzpatrick, Cella, Harper & Scinto

(57) ABSTRACT

A developing device includes a developer bearing member for bearing and conveying a developer having a toner and a carrier, a first magnetic pole arranged in the developer bearing member, a second magnetic pole arranged in the developer bearing member, a polarity of the second magnetic pole being opposite to a polarity of the first magnetic pole. The second magnetic pole is adjacent to the first magnetic pole and is arranged on a downstream side of the first magnetic pole in a moving direction of the developer bearing member. A regulating member regulates a layer thickness of the developer borne by the developer bearer. The regulating member is arranged in the vicinity of the second magnetic pole and a concentration detector for detecting a concentration of the toner in the developer.

30 Claims, 5 Drawing Sheets

DEVELOPING DEVICE AND IMAGE FORMING APPARATUS

BACKGROUND OF THE INVENTION

1. Field of the Invention

The present invention relates to an image forming apparatus, such as a copying machine, a printer, an apparatus for displaying recorded images, or a facsimile equipment, which forms visible images by developing electrostatic latent images formed on an image bearing member by an electrophotographic method, an electrostatic recording method, or the like. The invention also relates to a developing device used for the image forming apparatus.

2. Related Background Art

There has been known a developing device that bears a dry developer as a visualizing agent on a surface of a developer bearing member, and supplies this developer to the vicinity of a surface of an image bearing member that bears an electrostatic latent image so as to develop the electrostatic latent image into a visible image by applying an alternating electric field between the image bearing member and the developer bearing member.

In this respect, the developer bearing member described above is generally provided with a developing sleeve for use in many cases. The developer bearing member is, therefore, referred to as a "developing sleeve" in the following description. Also, since the image bearing member is generally provided with a photosensitive drum in many cases, the image bearing member is referred to as a "photosensitive drum" in the following description.

As the above-mentioned development method, there is known the so-called magnetic brush development method whereby to form a magnetic brush on a surface of a developing sleeve in which a magnet which serves as magnetic field generating means is disposed. The magnetic brush is made of a developer (two-component developer) comprising a two-component system composition (carrier particles and toner particles), for example. This method is arranged to enable the magnetic brush to slide on or approach the photosensitive drum that faces the magnetic brush with a fine development gap between them, and then, to apply continuously the alternating electric field between the developing sleeve and the photosensitive drum (between S-D), hence performing the development by the repeated transfer and counter-transfer of the toner particles from the developing sleeve to the photosensitive drum (as disclosed in the specifications of Japanese Patent Application Laid-Open No. 55-32060 and Japanese Patent Application Laid-Open No. 59-165082, for example).

As shown in FIG. 5, the developing device 18 for the two-component magnetic brush development is provided with a developing container 18*a* which is divided into a developing chamber R1 and an agitating chamber R2 by a partition wall 19. In the developing chamber R1 and the agitating chamber R2, the agitating and conveying screws 23 and 24 serving as the agitating and conveying members are rotatively contained, respectively. At an opening of the developing chamber R1, the developing sleeve 25, which rotates in a direction indicated by an arrow "c" in FIG. 5 is arranged to face the photosensitive drum 3 which rotates in a direction indicated by an arrow a with a fine gap therebetween. The magnet 29 is fixedly arranged in the interior of the developing sleeve.

Also, a regulating blade 28 is arranged to face the developing sleeve 25 with a predetermined gap in order to provide the developer on the surface of the developing sleeve 25 in a form of a thin film.

In the developing container 18*a*, there is contained the developer 22 having the toner particles and the magnetic particles mixed for it. The mixing ratio of the toner particles and the magnetic particles (hereinafter referred to as the "T/C ratio") is kept constant by droppig and supplying a toner in an amount matching that of the toner that has been consumed for development, from a toner storage chamber 21 that contains the toner to be supplied.

The dropped and supplied toner is agitated by the screw 24 in the agitating chamber R2 to be mixed with the developer 22 in the developing chamber 18*a*, and then carried. At this time, the developer 22 is conveyed along a longitudinal direction of the developing container in a direction opposite to a developer conveying direction in which the developer is conveyed by the conveying screw 23 in the developing chamber R1. The partition wall 19 is provided with openings on the front side and the back side respectively in FIG. 5. Through these openings, the developer is delivered.

Now, it is extremely important to maintain the T/C ratio of the two-component developer in the developing container 18*a* for the stabilized image output. Various methods have been proposed for the detection and maintenance of this ratio.

For example, detecting means is arranged on the circumference of the photosensitive drum 3 to irradiate light on the toner transferred from the developing sleeve 25 to the photosensitive drum 3. Thus, the toner supply amount is adjusted based on a transmitted light or a reflected light at that time. With the result thereof, the T/C ratio is detected. There is another method in which detecting means is arranged in the vicinity of the surface layer of the developing sleeve 25, and then, the T/C ratio is detected based on a reflected light when light is irradiated on the developer coated on the developing sleeve 25. Also, there is a method proposed and practiced, in which the T/C ratio is detected by the provision of a sensor in the developing container 18*a* to detect the change in the apparent magnetic permeability of the developer in a predetermined volume in the vicinity of the sensor by the utilization of the coil inductance.

However, the method of maintaining the T/C ratio at a constant value on the basis of an amount of the developing toner on the photosensitive drum 3 has a problem that the amount of toner on the photosensitive drum 3 is caused to change due to the factors other than the changes of the T/C ratio, such as the fluctuation of the gap between the photosensitive drum 3 and the developing sleeve 25 or the change in the electrical potential of a latent image, and as a result, the toner supply operation is made erroneous eventually. Also, the method of detecting the T/C ratio by the reflective light when the light is irradiated to the developer applied on the developing sleeve 25 has a problem that it becomes impossible to detect the exact T/C ratio if the detecting means is stained by the toner flown in all directions.

In contrast, the sensor that uses the method of detecting the T/C ratio by the detection of the change in the apparent magnetic permeability of the developer 22 within a predetermined volume in the vicinity of the sensor (hereinafter referred to the "toner concentration sensor") is not affected by the problem of the contamination due to the toner flown in all directions, while the costs of the sensor per se are lower. Therefore, this T/C ratio detecting means is best suited for the low-cost and smaller-space copying machine or an image forming apparatus, such as a printer.

The toner concentration sensor that utilizes the change in magnetic permeability of the developer as described above is arranged to determine that a T/C ratio of the developer becomes lower when the magnetic permeability of the developer within a predetermined volume becomes large, for example, and then, it causes the initiation of the toner supply. If, on the contrary, the magnetic permeability becomes smaller, it is determined that the T/C ratio of the developer is made higher, thus ceasing the toner supply. This sensor controls the T/C ratio of the developer in accordance with such sequence.

Nevertheless, the toner concentration sensor in the method of detecting the change in the apparent magnetic permeability of the developer within a predetermined volume as described above has a problem that if the bulk density of the developer itself, that is, the weight of the developer per unit volume, may be affected to present some changes, the apparent magnetic permeability of the developer may also change following the change in the bulk density, hence the sensor output being changed in accordance with the change in the magnetic permeability.

That is, even if a T/C ratio in a developing container remains the same, a bulk density in the developing container may be changed. This is because a change in an amount of a developer (carriers) in a predetermined volume in the vicinity of the toner concentration sensor causes a change in magnetic permeability at that time so that an output of the sensor is changed. As the result, even if a toner is not so consumed, the sensor may produce an output representative of a reduction of the toner so that a toner may be supplied. Conversely, even if an amount of the toner is reduced, the sensor may produce an output indicating that the toner is not reduced so that a toner supply cannot be performed.

In the former case, due to the excessive supply of toner, there is a problem that the image density becomes denser or the developer may overflow from the developing container due to the increased amount of developer along with the increase of the toner amount. There is also a problem that may be encountered that the toner flown in all directions or the like takes place due to the lowered amount of the electrostatic charge of the toner following the increased toner ratio in the developer.

In the latter case, there may be encountered a problem that the images are degraded or the image density becomes lighter due to the reduced amount of toner in the developer or the lighter image density or the like may take place due to the increased amount of the electrostatic charge of the toner.

After the detailed studies of the inventors hereof, it has been found that these problems are caused mostly by the change in the bulk density of the developer due to the change in the amount of the electrostatic charge of the toner in the developer.

If the fluctuation of the amount of the electrostatic charge of the toner is greater, it indicates the greater amount of change in force of repulsion between the developers. The greater the amount of the electrostatic charge of the toner, the greater becomes the force of repulsion between the developers. As a result, the space between the developers may spread more widely due to the greater force of repulsion to make the bulk density of the developer smaller.

Then, as another factor, it is found that the change in the temperature and humidity may exert an influence on the change in the amount of the electrostatic charge of the toner of the developer in a developer system and the developing device that adopts the aforesaid developing method. At a lower temperature with a lower humidity, the amount of moisture contained in the developer itself is reduced to increase the electrostatic charge on the toner generated by the contact between the toner and the carrier. Then, the repulsion between the developers becomes greater to make the bulk density of the developer smaller. On the contrary, if the temperature and humidity are high, the moisture content of the developer itself is increased to make it difficult to increase the electrostatic charge on the toner by the contact between the toner and the carrier. Thus, the repulsion between the developers becomes smaller to increase the bulk density of the developer.

In the specification of Japanese Patent Application Laid-Open No. 5-61353, for example, there is disclosed a method of changing a control voltage for controlling an intensity of a magnetic field generated by a toner concentration sensor in accordance with the temperature and humidity of the developer when the output of the toner concentration sensor fluctuates due to the changes in the aforesaid bulk density.

Also, in the specification of Japanese Patent Application Laid-Open No. 5-61353, there is a disclosure that the control voltage is changed to control the intensity of the magnetic field generated by the toner concentration sensor in accordance with the temperature characteristics of a varicap (variable capacitance diode) used for the oscillating circuit to generate the magnetic field of the toner concentration sensor. The temperature characteristics indicates the increase of the electrostatic capacitance if the temperature in the interior of an image forming apparatus becomes higher and indicates the reduction of the electrostatic capacitance if the temperature in the interior of the image forming apparatus becomes lower.

With the adoption of the aforesaid control method, it becomes possible to prevent the toner replenishment significantly from being erroneously operated due to the fluctuation of an amount of the electrostatic charge of the developer (toner) caused by the charge in temperature and humidity of the developer. Nevertheless, if toner should be prepared in ultrafine particles for obtaining recorded images in higher quality, there are still the problems yet to be solved as given below.

(1) After the output voltage of the toner concentration sensor is controlled under the and high humid environment, and after it is left intact for a long period of time, images are output for several thousands of sheets with the result that the T/C ratio of the developer is increased. Then, the density of copied image is increased for the one having a higher image ratio with the resultant toner adhesion to the background portion thereof.

(2) After the output voltage of the toner concentration sensor is controlled under the lower humid environment, several thousands of sheets of image are output from a source document having a lower image ratio on it. Then, the T/C ratio of the developer is lowered, and the reduction of the image density becomes lower considerably.

After the detailed studies made by the inventors hereof, it is found that these problems are caused by the following two phenomena.

One of the phenomena is brought about by the crushed toner in general use. The toner shape of each individual crushed toner is irregular, which easily results in the fluctuation of the bulk density of the developer in the stationary state, the flowing state, or in the state of being left intact, because of the individual difference in its shape. In addition, the fluctuation of the bulk density is greater due to the changes in the toner shape when the toner is in use for a long time.

The other one of them is the phenomenon related to the structure of the developing device. The developing sleeve in general use is arranged to rotate in the regular direction with respect to the photosensitive drum. Then, in order to prevent the uneven coating of the developer on the developing sleeve, the developer should be gathered in the vicinity of the regulating blade of the developing sleeve, and the structure should be arranged to compress the developer. Therefore, the longer the developing device is in use, the firmer the developer is compressed progressively.

In FIG. 5, the developing sleeve 25 rotates in the regular direction with respect to the photosensitive drum 3. As a result, it becomes necessary for the developing sleeve 25 to scoop up the developer from the developer container 18*a* by the function of the magnet 29. The magnet 29 is one having high magnetic force on two N magnetic poles and two S magnetic poles, respectively. Then, with the function thereof the developer 22 is scooped up. As a result, a magnetic binding force becomes stronger between the developing sleeve 25 and the regulating blade 28, thus compressing the developer 22 mechanically and magnetically. As a result, the bulk density of the developer is caused to change due to the change in the toner shape, or the bulk density of the developer is caused to change due to the external additives which are buried in it. Along with such changes, a change in magnetic permeability may take place within a predetermined volume of the developer after all.

Now, therefore, with the structure described above, the developer 22 is jammed into the collecting portion 16 of the developer in the vicinity of the regulating blade 28 for the developing sleeve 25, and the friction force between the developers themselves is increased by the rotation of the developing sleeve 25 if the developer is in a state where it is easily compressed. The more the developing sleeve 25 rotates, the more the amount of the electrostatic charge of the toner is increased. Thus, the change in the amount of the electrostatic charge of the toner becomes greater with respect to the initial amount of the electrostatic charge of the toner.

Therefore, it is necessary to change the control voltage that controls the intensity of the magnetic field generated by the toner concentration sensor in accordance with the environment, and also, to optimize the developer, as well as the structure of the developing device, for the further stabilization of the controlling method of the detected value of the toner concentration sensor.

SUMMARY OF THE INVENTION

It is an object of the invention to provide a developing device and an image forming apparatus, which are capable of controlling a toner concentration exactly.

It is another object of the invention to provide a developing device and an image forming apparatus, which are capable of suppressing a change in a bulk density and a change in an amount of the electrostatic charge of the developer to execute the exact toner concentration control.

It is still another object of the invention to provide a developing device which comprises:

(a) a developer bearing member for bearing and conveying a developer having a toner and carrier;

(b) a first magnetic pole arranged in the developer bearing member;

(c) a second magnetic pole arranged in the developer bearing member, wherein a polarity of the second magnetic pole is opposite to a polarity of the first magnetic pole, and the second magnetic pole is adjacent to the first magnetic pole, and arranged on a downstream side of the first magnetic pole in a moving direction of the developer bearing member;

(d) a regulating member for regulating a layer thickness of the developer borne by the developer bearing member, wherein, the regulating member is arranged in the vicinity of the second magnetic pole; and (e) a concentration detector for detecting a concentration of the toner in the developer.

Also, it is a further object of the invention to provide an image forming apparatus which comprises:

(a) a developer bearing member for bearing and conveying a developer having a toner and carrier;

(b) a first magnetic pole arranged in the developer bearing member;

(c) a second magnetic pole arranged in the developer bearing member, wherein a polarity of the second magnetic pole is opposite to the polarity of the first magnetic pole, and the second magnetic pole being adjacent to the first magnetic pole, and arranged on a downstream side of the first magnetic pole in a moving direction of the developer bearing member;

(d) a regulating member for regulating a layer thickness of the developer borne by the developer bearing member, wherein the regulating member is arranged in the vicinity of the second magnetic pole; and (e) a concentration detector for detecting a concentration of the toner in the developer.

Other objectives and advantages beside those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiment of the invention, and therefore reference is made to the claims which follow the description for determining the scope of the invention.

DETAILED DESCRIPTION OF THE PREFERRED EMBODIMENTS

Figure 4:
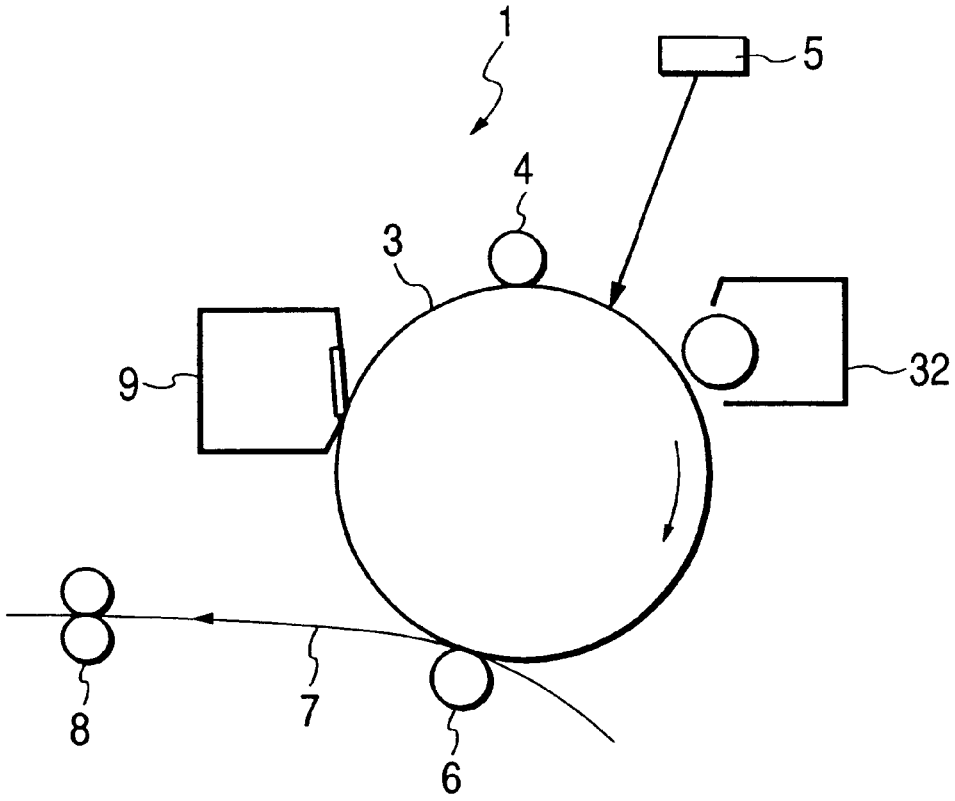
FIG. 4 is a structural view which schematically shows one embodiment of an electrophotographic image forming apparatus to which the present invention is applicable.

Hereinafter, with reference to the accompanying drawings, a description will be made of a developing device and an image forming apparatus further in detail in accordance with the present invention. Here, for the embodiments which follow, the present invention will be described as the one which is embodied in an electrophotographic image forming apparatus as shown in FIG. 4, for example. However, it is to be understood that the present invention is not necessarily limited to such example.

In FIG. 4, the electrophotographic image forming apparatus 1 is provided with a photosensitive drum 3 serving as an image bearing member, which is rotatably arranged. The photosensitive drum 3 is uniformly charged by a primary charger 4, and then a light emitting element 5, such as a laser, exposes the photosensitive drum 3 with an information signal to form an electrostatic latent image, and then the latent image is developed into a visible image by a developing device 32. Then, the visible images are transferred to a transfer sheet 7 by a transfer charger 6, and the images are fixed by a fixing device 8 to obtain permanent images. Also, after transfer, a residual toner on the photosensitive drum 3 is removed by a cleaning device 9.

[First Embodiment]

In conjunction with FIG. 1 and FIG. 2, a description will be made of a first embodiment in accordance with the present invention.

Figure 1:
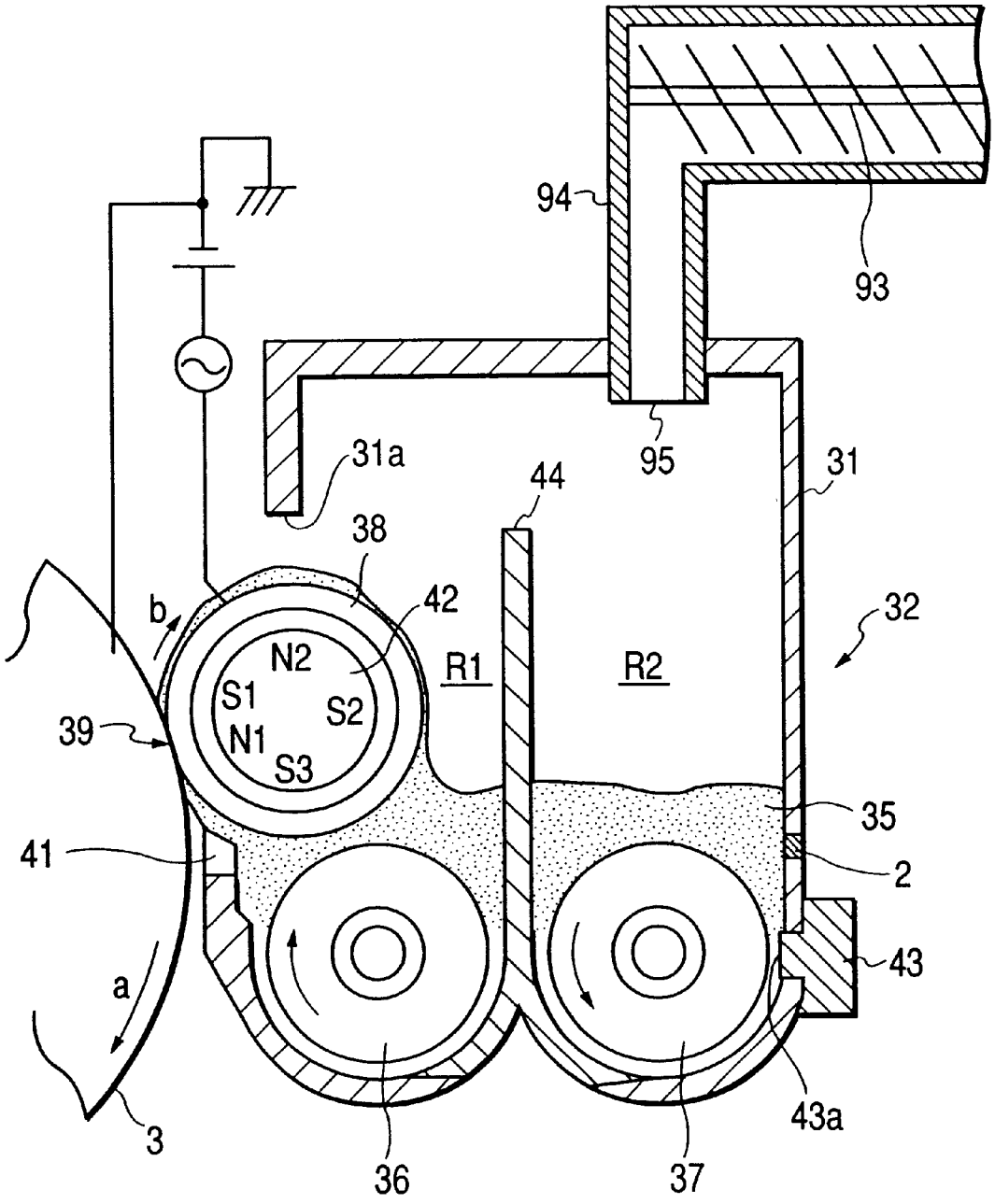
FIG. 1 is a structural view which shows a developing device in accordance with a first embodiment of the present invention.
Figure 2:
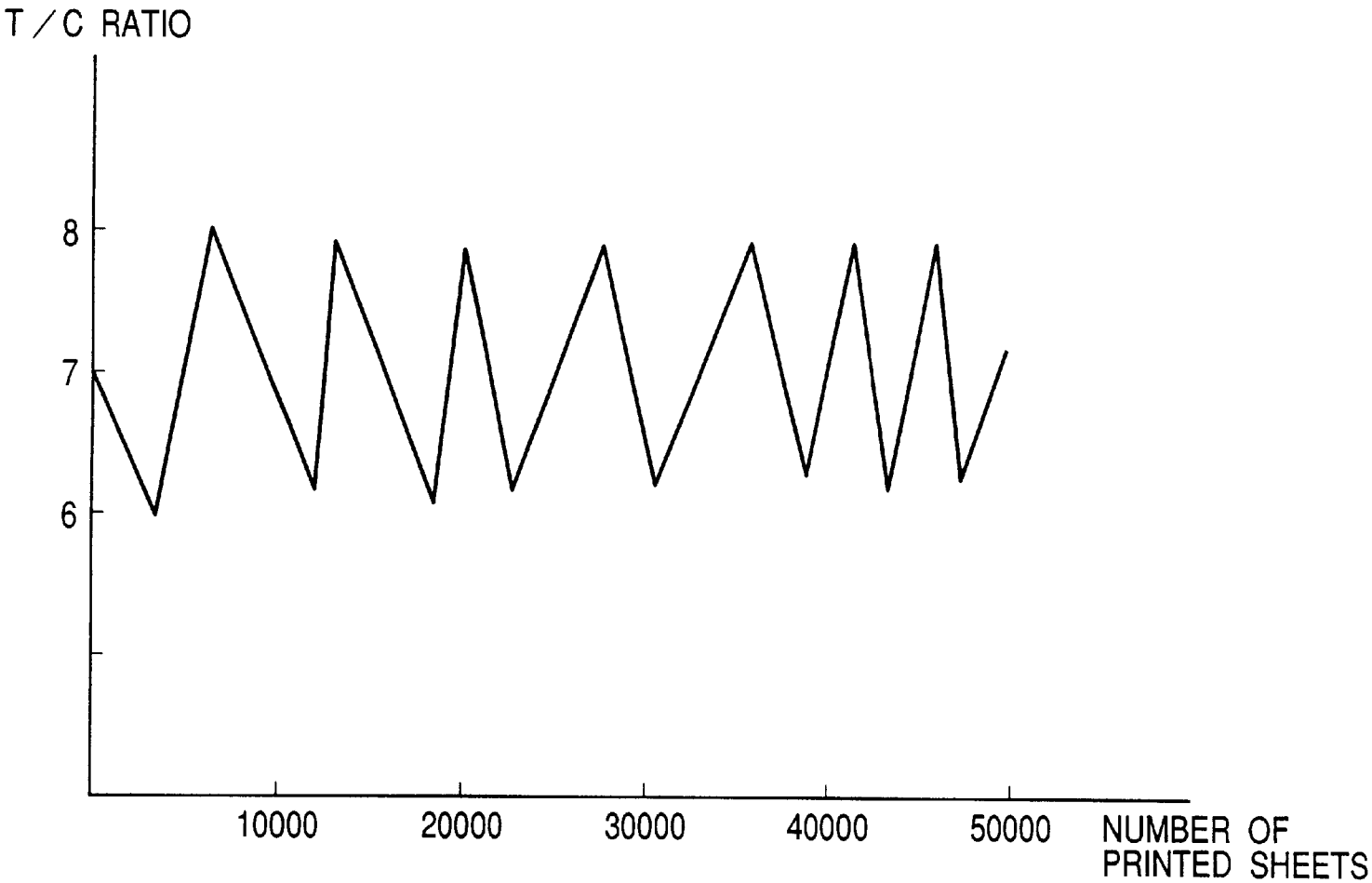
FIG. 2 is a graph which shows a relationship between a number of printed sheets and a T/C ratio to indicate an effect of a toner concentration control in accordance with the first embodiment.

In FIG. 1, the developing device 32 is provided with a developing container 31. The interior of the developing container 31 is divided by a partition wall 44 into a developing chamber R1 and an agitating chamber R2. Above the agitating chamber R2, a toner storage chamber 94 is arranged. In the toner storage chamber 94, a toner for replenishment is stored. An amount of toner matching that of the toner which has been consumed for development is conveyed by a conveying screw 93 and dropped from a supply port 95 arranged on the lower part of the toner storage chamber 94 to replenish the agitating chamber R2 with the toner.

Meanwhile, a developer 35 which is prepared by mixing toner particles and magnetic carriers is retained in the developing chamber R1 and the agitating chamber R2.

In the developing chamber R1, an agitating and conveying screw (hereinafter referred to simply as a "screw") 36 is arranged for serving as a developer agitating and conveying member which is spirally configured with an excellent function to agitate the developer and convey it. With the rotation of the screw 36, the developer is conveyed in a longitudinal diction of a developing sleeve 38 which serves as a developer bearing member.

In the agitating chamber R2, there is likewise arranged a rotatable spiral screw 37. In the agitating chamber R2, a direction in which the developer is conveyed by the screw 37 is opposite to a developer conveying direction of the screw 36 in the developing chamber R1. On the partition wall 44, openings (not shown) are arranged, respectively, on the front side and back side in FIG. 1. The developer conveyed by the screw 36 is delivered to the screw 37 through one of the openings, and then, the developer conveyed by the screw 37 is delivered to the screw 36 though the other of the openings.

Also, in a portion of the developing container 31 near the photosensitive drum 3, an opening portion 31*a* is arranged. In this opening portion, a developing sleeve 38 is arranged, which serves as a developer bearing member made of aluminum, non-magnetic stainless steel or the like, having an appropriate irregularity on the surface thereof.

In accordance with the present embodiment, the developing sleeve 38 is arranged to rotate at a circumferential speed Vb in the direction indicated by an arrow "b" (in the opposite direction to the rotational diction of the photosensitive drum 3 indicated by an arrow "a"). Then, after the developer is regulated to an appropriate layer thickness by a layer thickness regulating blade 41 which serves as a developer regulating member arranged on the lower end of the opening portion 31*a* of the developing container 31, the developer is borne and conveyed by the developing sleeve 38 to the developing area 39. In this respect, the description will be made later of an effect of the present invention which is obtainable by arranging the developing sleeve 38 to rotate in the direction opposite to the rotational direction of the photosensitive drum 3.

A magnetic brush of the developer borne on the developing sleeve 38 is in contact with the photosensitive drum 3 in the developing area 39, which rotates at a circumferential speed Va in the direction indicated by the arrow "a". In the developing area, the electrostatic latent images are developed. It is preferable to set the circumferential speed Vb of the development sleeve 38 at a ratio of 130 to 200% of the circumferential speed of the photosensitive drum. It is more preferable to set it at 150 to 180%. It is impossible to obtain any sufficient image density in a range less than those described above. Also, the flying of the developer is allowed to take place in a range more than those described above.

In the developing sleeve 38, a roller-shaped (cylindrical) magnet 42 is fixedly arranged to serve as magnetic field generating means. The magnet 42 is provided with a developing magnetic pole N1 which faces the developing area 39. The magnetic brush of the developer is produced by the developing magnetic field formed by the developing magnetic pole N1 in the developing area 39. When the magnetic brush is in contact with the photosensitive drum 3, an electrostatic latent image is developed. At this time, the toner adhering to the magnetic brush and the toner adhering to the surface of the developing sleeve 38 are transferred to an image area of the electrostatic latent image. For the present embodiment, the magnet 42 is provided with each of the conveying magnetic poles N2, S1, S2, and S3 in addition to the aforesaid developing magnetic pole N1.

With the rotation of the developing sleeve 38, the developer 35 coated on the developing sleeve 38 by the S3 pole is conveyed to the developing magnetic pole N1 through the layer thickness regulating blade 41, and the developer which stands like the ears of rice in the magnetic field develops the electrostatic latent image on the photosensitive drum 3. After that, by the repulsion magnetic field between the S2 pole and the S3 pole, the developer on the development sleeve 38 is allowed to fall off into the developing chamber R1. The developer thus dropped off into the developing chamber R1 is agitated and conveyed by the screws 36 and 37.

Incidentally, a voltage produced by superposing a DC voltage with an AC voltage is applied to the developing sleeve 38, to form an alternating electric field in the developing area 39. Then, by the utilization of the alternating electric field, the electrostatic latent image is developed.

The toner concentration sensor 43 which serves as toner concentration controlling means for the present embodiment is arranged on a side surface of the agitating chamber R2 as shown in FIG. 1. However, it may be possible to position this sensor some other location where the developer is provided for the sensor surface (detecting surface) of the toner concentration sensor 43 in a thickness good enough to detect the toner concentration so that the developer presents a constant specific flow at the time of developer agitation.

In accordance with the present embodiment, the so-called inductance detection sensor which detects the magnetic permeability of the developer is used for the toner concentration sensor 43 as described earlier.

Also, it is preferable to set a location of a temperature and humidity sensor 2 in the vicinity of the toner concentration sensor as shown in FIG. 1, because this sensor is arranged for the purpose to detect the temperature and humidity of the developer residing near the toner concentration sensor.

Now, a detailed description will be made of the toner concentration control, the developer, and the structure of the developing unit in the developing device 32 in accordance with the present embodiment. The control for changing a value of a detected output of the toner concentration sensor 43 in accordance with a change in temperature and humidity of the developer used for the present embodiment is such that the temperature and humidity data obtained from the temperature and humidity sensor 2 or a table from which an amount of moisture in the developer is picked up based on the temperature and humidity data is provided in an interior of the image forming apparatus 1, and then, with the amount of moisture in the developer, a value of a detected output of the toner concentration sensor 43 is changed to correct a difference ΔV between a value of a reference output V1 of the sensor 43 at the time of the sensor 43 having been set initially, and a value of a changed output V2 of the sensor 43 due to change in the temperature and humidity of the developer.

The toner particles used for the present embodiment are a spherical polymer toner, and the method for manufacturing them is such as to suspend in a water-based medium a monomer composition prepared by adding colorant and an electric charge controlling additive to the polymerizing monomer, and then, to polymerize it to obtain the spherical toner particles. (In this respect, the method of manufacture is not necessarily limited to the one described above. It may be possible to adopt the emulsion polymerization method or the like. Also, it may be possible to use some other additives.)

The shape coefficient of the spherical polymer toner obtainable by the adoption of this method is: the SF-1, 100 to 180, and the SF-2, 100 to 140.

Here, 100 samples of toner are prepared at random using the FE-SEM (S-800) manufactured by Hitachi, Ltd. Then, the image information of the samples is inputted into the image analyzer (Luzex 3) manufactured by the Nicolet Japan Corporation via an interface.

The SF-1 and SF-2 define values derived by the following expression:

$$SF\text{-}1=\{(MXLNG)^2/\mathrm{AREA}\}\times(\pi/4)\times 100$$

$$SF\text{-}2=\{(PERI)^2/\mathrm{AREA}\}\times(\pi/4)\times 100$$

(where MXLNG is an absolute maximum length; AREA is a toner projection area; PERI is a circumferential length).

The toner shape coefficient SF-1 indicates a degree of sphericity, and beginning with 100 or greater, the spherical shape becomes gradually indefinite. The SF-2 indicates a degree of irregularity, and beginning with 100 or greater, the irregularity of toner surface becomes more conspicuous.

As compared with the shape coefficient of the spherical polymer toner described above, a shape coefficient of the conventional crushed toner is: the SF-1, 180 to 220, and the SF-2, 180 to 200. As compared with the conventional crushed toner, the shape of the toner particle of the spherical polymer toner is closer to the perfect sphere. The changing rate of the shape coefficient of the particle of the spherical polymer toner is smaller than that of the conventional crushed toner. When the developing device is in operation for a period of five hours, a change in the shape coefficient of the spherical polymer toner is: SF-1, 100 to 120 and the SF-2, 100 to 120, which indicates almost no change in the shape thereof. However, the crushed toner presents the SF-1, 120 to 150, and the SF-2, 120 to 140, which indicates that the shape of the crushed toner becomes closer to the sphere. This is because the irregular surface layer of the crushed toner is worn off by the friction between the toner and carrier or between toner and toner when agitated, and each particle becomes closer to the sphere, thus presenting greater change in its shape. In contrast, the spherical polymer toner is closer to the perfect sphere from the very beginning. As a result, its original shape is not much affected unlike the crushed toner.

Form the fact described above, the shape of particle of the crushed toner has a greater change. Then, the rate of change in the contact area is also greater between the developers themselves. The gap rate, and the bulk density are also caused to change greatly. In contrast, the particle shape of the spherical polymer toner has a smaller change as described above. The bulk density does not change much, and the output of the inductance detection sensor does not fluctuate very much.

Also, the structural features of the developing device of the present embodiment are that the developing sleeve 38 is arranged to rotate in a direction (clockwise in FIG. 1) opposite to a rotational direction of the photosensitive drum 3 in an area where the developing sleeve 38 and the photosensitive drum 3 face each other as described above.

As shown in FIG. 1, with the structure in which the developing sleeve 38 is arranged to rotate in the direction opposite to the rotational direction of the photosensitive drum 3, the developer in the developing chamber R1 is scooped up by the S3 pole to coat the developer 35 on the developing sleeve 38, and then, the coating amount on the developing sleeve 38 is controlled by regulating the developer coated on the developing sleeve 38 by the regulating blade 41.

Figure 5:
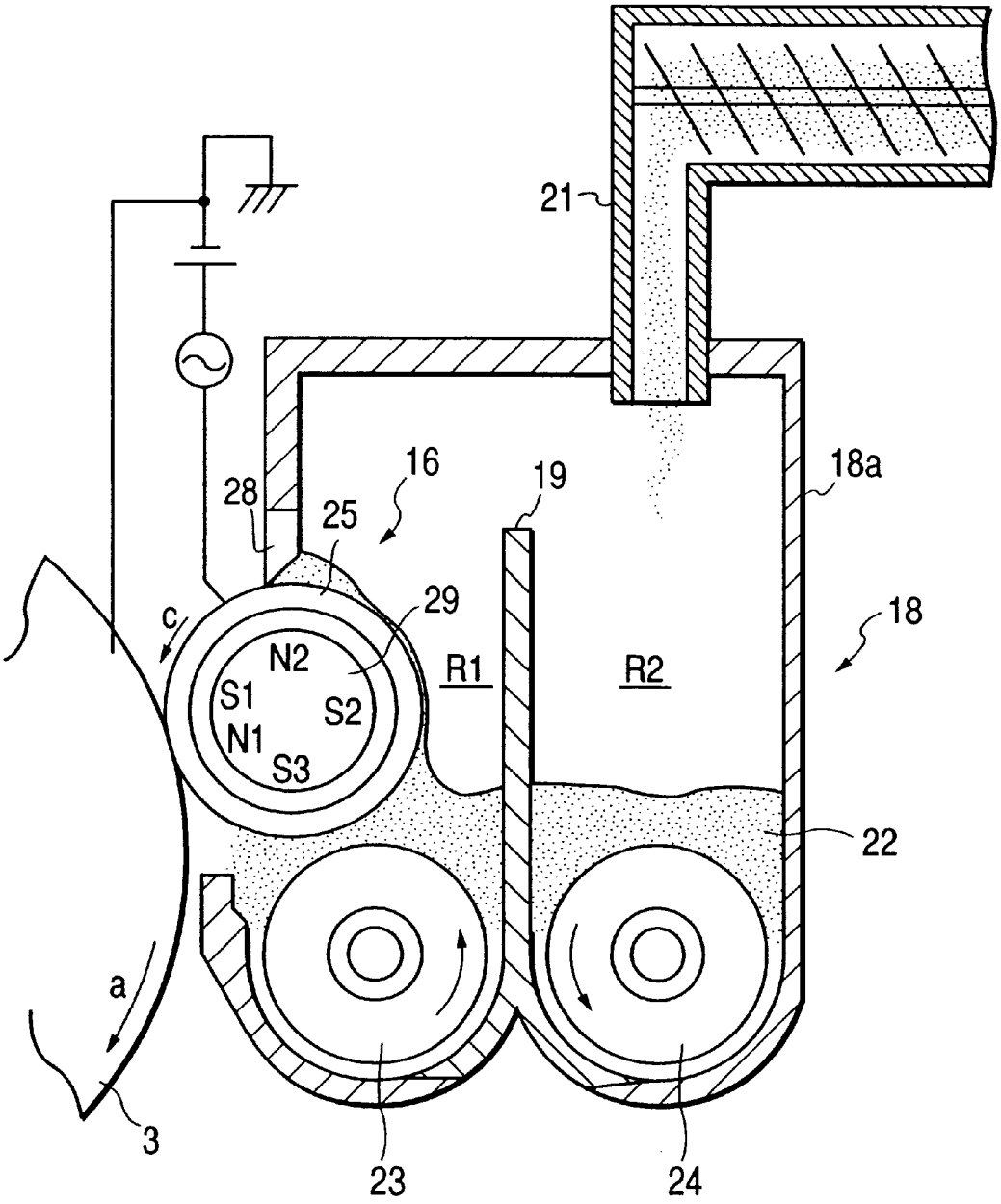
FIG. 5 is a structural view which shows one example of a developing device.

Therefore, unlike the rotation of the developing sleeve in the regular direction as shown in FIG. 5 in which the developer is progressively jammed into the vicinity of the regulating blade 28 for the developing sleeve 25, the structure is not made to scoop up the developer from the developing container, but the structure enables the magnetic binding force to be weaker between the developing sleeve 38 and the regulating blade 41 by use of the magnetic pole S3 of the magnet 42 of the developing sleeve 38 than the conventional art in which N2 pole and S2 pole are used. Further, there is no need for arranging the gathering of the developer between the developing sleeve and the regulating blade in order to prevent the unevenness of coating on the developing sleeve 38. As a result, the compression of the developer is not great in the vicinity of the regulating blade 41 for the developing sleeve 38, hence making it possible to prevent the developer from being deteriorated, as well as to suppress the fluctuation of the amount of the electrostatic charge of the toner. In this manner, it becomes possible to suppress the change in the bulk density of the developer due to the change in the toner shape or to suppress the change in the amount of the electrostatic charge of the toner following the compression of the developer. As a result, it leads to the reduction of the change in the bulk density due to the repulsion between the developers themselves, hence suppressing the output fluctuation of the inductance detection sensor.

In other words, the inventors have improved a developing device, which is a CLC 700 developing device manufactured by Canon, to arrange the toner concentration sensor, the spherical polymer toner, and the regulating blade underneath the developing sleeve. Then, with the system of the present invention, that is, the developing sleeve is allowed to rotate clockwise in FIG. 1, the inventors have conducted experimental trials of the actual machine to confirm the effect thereof under a lower humid environment (23° C., 5% r.h) after the initial setting and image formation under the environment of the experimental room (25° C., 60% r.h). As a result, it has been confirmed that with the replenishment durability of 50,000 sheets by using source documents having different image ratios, the control of ±1% is achieved centering on the T/C ratio of 7%, that is, as indicated on the graph shown in FIG. 2, the toner replenishment begins when the T/C ratio becomes 6%, and the toner replenishment can be ceased when the T/C ratio becomes 8%.

Also, under a high humid environment (30° C., 80% r.h), the same effect has been obtained.

As described above, in accordance with the present embodiment, the bulk density of the developer does not change much with respect to the change in the shape of the developer nor changes the amount of the electrostatic charge of the toner much due to the compression of the developer in the gathering portion of the developer in the vicinity of the regulating blade for the developing sleeve. Then, with the change in the control voltage of the toner concentration sensor in accordance with the temperature and humidity of the developer, it becomes possible to effectuate correction exactly with respect to the change in the bulk density of the developer, thus controlling the T/C ratio exactly in a better condition.

[Second Embodiment]

Now, in conjunction with FIG. 3, the description will be made of a second embodiment in accordance with the present invention.

For the first embodiment, the change in the amount of the electrostatic charge of the toner is suppressed with the structural arrangement of the developing device using the spherical polymer toner, in which the developing sleeve is arranged to rotate in the direction (clockwise in FIG. 1) opposite to the rotational direction of the photosensitive drum. The present embodiment is, however, characterized in that the amount of the electrostatic charge of the toner is suppressed by changing the properties and materials of the carrier.

Figure 3:
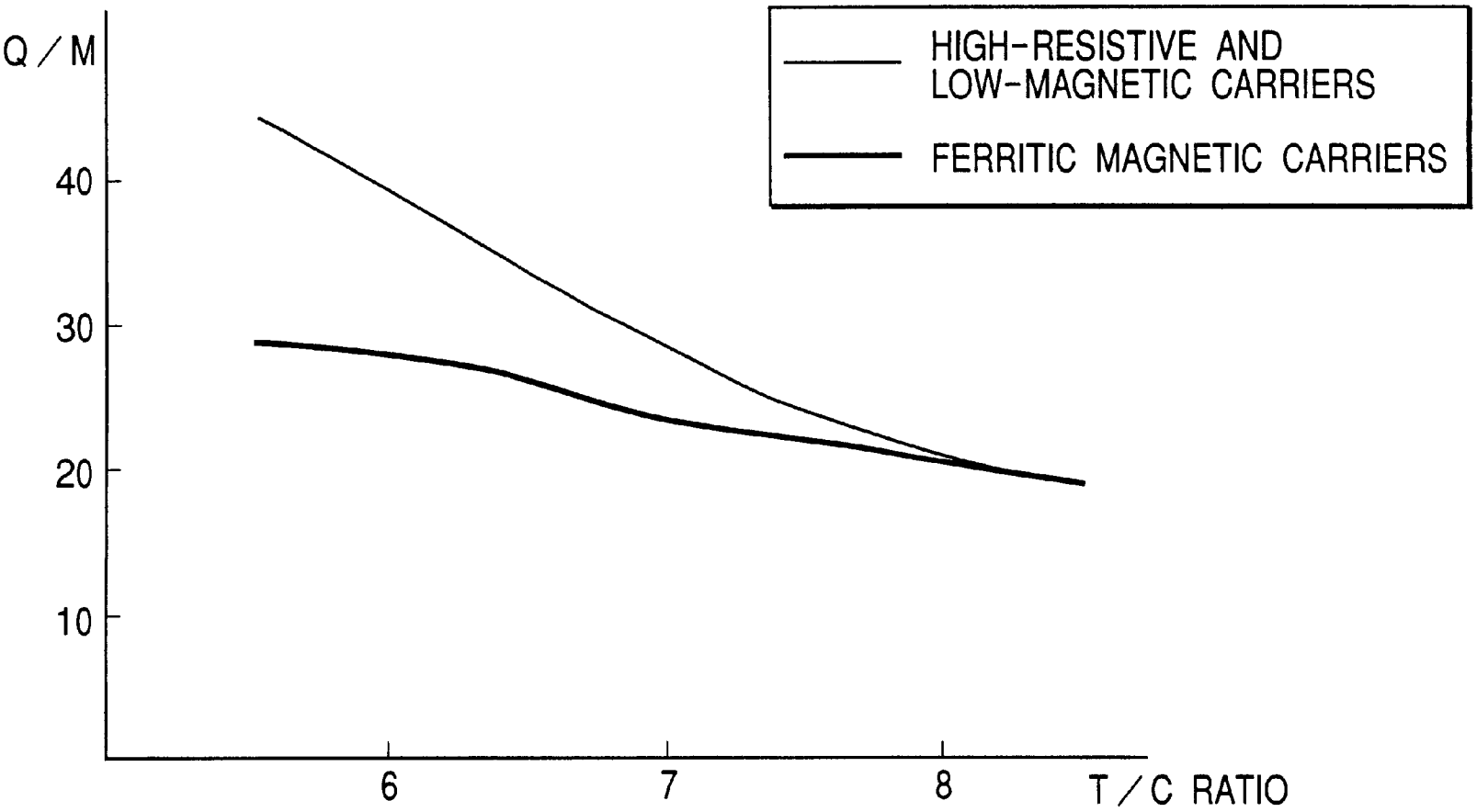
FIG. 3 is a graph which shows a relationship between a T/C ratio and an amount of an electrostatic charge of the toner (Q/M) with respect to a high-resistive and low magnetic carrier and a conventional ferritic magnetic carrier.

The graph shown in FIG. 3 represents the change in the amount of the electrostatic charge of the toner (Q/M) with respect to the change in the T/C ratio of the ferritic magnetic carrier of the conventional art and that of the high-resistive and low-magnetic carrier of the embodiment which makes it possible to suppress an amount of a change in the triboelectricity. It is understandable from the graph that the high-resistive and low-magnetic carrier of the present embodiment has a smaller change in the amount of the electrostatic charge of the toner than the ferritic magnetic carrier conventionally in use. With this phenomenon in view, the inventors have made observations as given below.

The shape coefficient is different between the high-resistive and low-magnetic carrier of the present invention and the ferritic magnetic carrier. Whereas the high-resistive and low-magnetic carrier has its SF1 at 100 to 140, and SF-2 at 100 to 120, the ferritic magnetic carrier has its SF-1 at 140 to 180 and SF-2 at 145 to 185 with the irregular surface layer. As a result, within in the range of the T/C ratios at which the comparative measurements have been carried out, the ferritic magnetic carrier has the wider contact area with toner thereby to provide the triboelectricity more, and also, with the lower resistance of the carrier itself, the accumulation of the electrostatic charge in carrier is smaller so as not be easily saturated. However, if the T/C ratio becomes higher, the toner makes the area of the carrier coverage higher. Then, the amount of the electrostatic charge of the toner becomes lower than that at the time of lower T/C ratio. In contrast, the resistivity of the carrier itself is as high as $1\times10^{10}$ to $1\times10^{14}$ Ω·cm for the high-resistive and lower-magnetic carrier, hence making it possible to accumulate the electrostatic charge which has been provided by the contact with toner. Then, the amount of the electrostatic charge of the toner is easily saturated. As a result, even if the T/C ratio is caused to change, the change in the saturated amount of the electrostatic charge of the carriers is smaller. So that the change in the amount of the electrostatic charge of the toner are smaller.

As described above, if the change in the amount of the electrostatic charge of the toner can be suppressed with respect to the change in the T/C ratio, it becomes possible to provide the developer, as well as the structure of a developing device, with smaller change in the bulk density of the developer in combination with the first embodiment. Further, it becomes possible to perform the control whereby to enable the detected value of the toner concentration sensor to be restored to the reference value depending on the temperature and humidity of the developer. In this manner, the correction can be made exactly for the change in the bulk density of the developer more reliably, hence executing the T/C ratio control exactly in a better condition.

Also, in accordance with the present embodiment, the aforesaid high-resistive and low-magnetic carrier is produced by polymerizing the binder resin, the magnetic metal oxide, and the resin magnetic carrier made of non-magnetic metal oxide. However, some other carrier may be adoptable if only such carrier can be produced by some other method whereby to make it possible to suppress the change in the amount of the electrostatic charge of the toner.

What is claimed is:

1. A developing apparatus comprising:

a developing bearing member for bearing a developer having a toner and a carrier to convey the developer to a developing portion;

magnetic field generating means disposed in said developer bearing member for generating a magnetic field, wherein said magnetic field generating means includes a first magnetic pole and a second magnetic pole disposed adjacently to and downstream of said first magnetic pole in a moving direction of said developer bearing member, said second magnetic pole having a same polarity as said first magnetic pole;

a regulating member for regulating a layer thickness of the developer borne on said developer bearing member; and detecting means for detecting information corresponding to a magnetic permeability of the developer, wherein, said regulating member is disposed in a vicinity of said second magnetic pole.

2. A developing apparatus according to claim 1, wherein a density of the toner in said developing apparatus is controlled in accordance with an output of said detecting means.

3. A developing apparatus according to claim 2, further comprising temperature-and-humidity detecting means for detecting temperature and humidity, wherein the output of said detecting means is corrected in accordance with the output of said temperature-and-humidity detecting means.

4. A developing apparatus according to claim 1, wherein a shape coefficient SF-1 of the toner is in the range of 100 to 140, and a shape coefficient SF-2 of the toner is in the range of 100 to 120.

5. A developing apparatus according to claim 1, wherein a shape coefficient SF-1 of the carrier is in the range of 100 to 140, and a shape coefficient SF-2 of the carrier is in the range of 100 to 120.

6. A developing apparatus according to claim 1, wherein a resistivity of the carrier is in the range of $1\times10^{10}$ to $1\times10^{14}$ Ω·cm.

7. A developing apparatus according to claim 1, wherein the carrier is a resin magnetic carrier produced by polymerizing a binder resin, a magnetic metal oxide, and a nonmagnetic metal oxide.

8. A developing apparatus according to claim 1, wherein a shape coefficient SF-1 of the carrier is in the range of 100 to 140.

9. A developing apparatus according to claim 1, wherein a shape coefficient SF-2 of the carrier is in the range of 100 to 120.

10. A developing apparatus according to claim 1, wherein a voltage of a DC voltage superposed with an AC voltage is applied to said developer bearing member.

11. A developing apparatus according to claim 1, wherein the developer falls off said developer bearing member in a position downstream of said first magnetic pole and upstream of said second magnetic pole in the moving direction of said developer bearing member.

12. A developing apparatus according to claim 1, wherein said magnetic field generating means is stationarily disposed in said developer bearing member.

13. A developing apparatus according to claim 1, wherein said magnetic field generating means has a third magnetic pole disposed in the vicinity of said developing portion, said third magnetic pole having a polarity opposite to the polarity of said second magnetic pole.

14. A developing apparatus according to claim 1, wherein said regulating member is disposed below said developer bearing member.

15. A developing apparatus according to claim 1, wherein the moving direction of said developer bearing member is opposite to a moving direction of an image bearing member in said developing portion.

16. An image forming apparatus comprising:

a developer bearing member for bearing a developer having a toner and a carrier to convey the developer to a developing portion;

magnetic field generating means disposed in said developer bearing member for generating a magnetic field, wherein said magnetic field generating means includes a first magnetic pole and a second magnetic pole disposed adjacently to and downstream of said first magnetic pole in a moving direction of said developer bearing member, said second magnetic pole having the same polarity as said first magnetic pole;

a regulating member for regulating a layer thickness of the developer borne on said developer bearing member; and detecting means for detecting information corresponding to a magnetic permeability of the developer, wherein, said regulating member is disposed in a vicinity of said second magnetic pole.

17. An image forming apparatus according to claim 16, wherein a density of the toner in said image forming apparatus is controlled in accordance with an output of said detecting means.

18. An image forming apparatus according to claim 17, further comprising temperature-and-humidity detecting means for detecting temperature and humidity, wherein the output of said detecting means is corrected in accordance with the output of said temperature-and-humidity detecting means.

19. An image forming apparatus according to claim 16, wherein a shape coefficient SF-1 of the toner is in the range of 100 to 140, and a shape coefficient SF-2 of the toner is in the range of 100 to 120.

20. An image forming apparatus according to claim 16, wherein a shape coefficient SF-1 of the carrier is in the range of 100 to 140, and a shape coefficient SF-2 of the carrier is in the range of 100 to 120.

21. An image forming apparatus according to claim 16, wherein a resistivity of the carrier is in the range of $1\times10^{10}$ to $1\times10^{14}$ Ω·cm.

22. An image forming apparatus according to claim 16, wherein the carrier is a resin magnetic carrier produced by polymerizing a binder resin, a magnetic metal oxide, and a nonmagnetic metal oxide.

23. An image forming apparatus according to claim 16, wherein a shape coefficient SF-1 of the carrier is in the range of 100 to 140.

24. An image forming apparatus according to claim 16, wherein a shape coefficient SF-2 of the carrier is in the range of 100 to 120.

25. An image forming apparatus according to claim 16, wherein a voltage of a DC voltage superposed with an AC voltage is applied to said developer bearing member.

26. An image forming apparatus according to claim 16, wherein the developer falls off and said developer bearing member in a position downstream of said first magnetic pole and upstream of said second magnetic pole in the moving direction of said developer bearing member.

27. An image forming apparatus according to claim 16, wherein said magnetic field generating means is stationarily disposed in said developer bearing member.

28. An image forming apparatus according to claim 16, wherein said magnetic field generating means has a third magnetic pole disposed in the vicinity of said developing portion, said third magnetic pole having a polarity opposite to the polarity of said second magnetic pole.

29. An image forming apparatus according to claim 16, wherein said regulating member is disposed below said developer bearing member.

30. An image forming apparatus according to claim 16, wherein the moving direction of said developer bearing member is opposite to a moving direction of an image bearing member in said developing portion.

* * * * *

UNITED STATES PATENT AND TRADEMARK OFFICE

CERTIFICATE OF CORRECTION

PATENT NO. : 6,389,245 B2
DATED : May 14, 2002
INVENTOR(S) : Masanori Shida et al.

It is certified that error appears in the above-identified patent and that said Letters Patent is hereby corrected as shown below:

Column 1,
Line 33, “whereby” should read -- used --; and
Line 61, “arrow a” should read -- arrow “a” --.

Column 2,
Line 5, “droppig” should read -- dropping --.

Column 4,
Line 23, “indicates” should read -- indicate --;
Line 26, “indicates” should read -- indicate --; and
Line 39, “the and high” should read -- a high --.

Column 6,
Line 31, “embodiment” should read -- embodiments --.

Column 7,
Line 37, “diction” should read -- direction --; and
Line 58, “diction” should read -- direction --.

Column 8,
Line 51, “some” should read -- at some --.

Column 10,
Line 5, “form” should read -- from --.

Column 11,
Line 54, “in” should be deleted; and
Line 60, “be” should read -- to be --.

Column 12,
Line 3, “smaller. So” should read -- smaller, so --; and
Line 5, “are” should read -- is --.

UNITED STATES PATENT AND TRADEMARK OFFICE

CERTIFICATE OF CORRECTION

PATENT NO. : 6,389,245 B2
DATED : May 14, 2002
INVENTOR(S) : Masanori Shida et al.

It is certified that error appears in the above-identified patent and that said Letters Patent is hereby corrected as shown below:

Column 14,
Line 35, "and" should be deleted.

Signed and Sealed this

Twenty-third Day of July, 2002

*Attest:*

*Attesting Officer*

JAMES E. ROGAN
*Director of the United States Patent and Trademark Office*